US006434948B1

(12) United States Patent
Eide et al.

(10) Patent No.: US 6,434,948 B1
(45) Date of Patent: Aug. 20, 2002

(54) LNG LOAD TRANSFER SYSTEM

(75) Inventors: Jorgen Eide, Stend; Svein Are Løtvedt, Nesbru; Jan-Kristian Haukeland, Sola; Jonas Schanche Sandves, Sandnes, all of (NO)

(73) Assignee: Den Norske Stats Oljeselskap A.S. and Navion AS, Stavanger (NO)

( * ) Notice: Subject to any disclaimer, the term of this patent is extended or adjusted under 35 U.S.C. 154(b) by 0 days.

(21) Appl. No.: 09/601,119

(22) PCT Filed: Jan. 29, 1999

(86) PCT No.: PCT/NO99/00026

§ 371 (c)(1),
(2), (4) Date: Aug. 28, 2000

(87) PCT Pub. No.: WO99/38762

PCT Pub. Date: Aug. 5, 1999

(30) Foreign Application Priority Data

| | | |
|---|---|---|
| Jan. 30, 1998 | (NO) | 19980431 |
| Feb. 10, 1998 | (NO) | 19980579 |
| Apr. 30, 1998 | (NO) | 19981991 |

(51) Int. Cl.[7] ..... F17C 7/02

(52) U.S. Cl. ..... 62/50.1; 62/50.7; 62/53.1; 62/240

(58) Field of Search ..... 62/50.1, 50.7, 62/53.1, 240

(56) References Cited

U.S. PATENT DOCUMENTS

| | | | | |
|---|---|---|---|---|
| 3,984,059 A | * | 10/1976 | Davies | 141/387 |
| 4,232,983 A | * | 11/1980 | Cook et al. | 405/210 |
| 5,199,266 A | * | 4/1993 | Johansen | 62/240 |
| 5,293,751 A | * | 3/1994 | Asai | 62/53.1 |

FOREIGN PATENT DOCUMENTS

DE 26 42 654 A1 3/1978

* cited by examiner

*Primary Examiner*—Ronald Capossela
(74) *Attorney, Agent, or Firm*—Foley & Lardner

(57) ABSTRACT

This invention concerns a unitary system for export of liquid natural gas (LNG) from a floating production vessel (FPSO vessel) (1), with the new and inventive consists of the combination of the following points: an LNG buffer tank in the FPSO vessel, with buffer storage capacity for temporary storage of the continuous produced LNG during an LNG tank vessel's absence, a mooring device arranged for short separation moorage between the FPSO vessel's stem and an LNG tank vessel's bow, a cryogenic transfer device arranged between the FPSO vessel's stem and an LNG tank vessel's bow, comprising a flexible LNG pipe and arranged for consecutive transfer of produced LNG; at least one or several LNG storage tanks in an LNG tank vessel, arranged for continuous filling via the cryogenic transfer device until the desired degree of filling of the LNG tank vessel is achieved.

39 Claims, 14 Drawing Sheets

LNG LOAD TRANSFER SYSTEM

INTRODUCTION

This invention relates to a system combining two vessels for handling liquid natural gas and other natural petroleum products, with one vessel being a floating production, storage and offloading lying at a petroleum producing seabed arrangement, ant with the other vessel being an LNG tank vessel or an ordinary tanker.

STATEMENT OF PROBLEM

In connection with and during offshore production of floating gas (LNG, NGL and LPG) usually stabilized oil and/or condensate is produced. Delivery of LNG is usually tied to long-term contracts, while gas condensate contains light or "volatile" petroleum components which may be delivered at a spot marked to the refinery which at any time might need such light petroleum components for the refining process. The vessels devices for the export system from such a combined offshore oil/gas conversion FPSO must satisfy both these products, export demands in a way so that two different tanker vessels like LNG tank vessels and conventional tank vessels shall be able to moorage to the FPSO-vessel and be connected with their respective transfer systems, whereof the first is cryogenic for LNG transfer, and the second may be arranged for transfer of petroleum components being fluid at higher temperatures.

DEFINITIONS

Liquid Natural Gas "LNG" is a liquid, fluid methane, with boiling point between −165° C. and −163° C.

Gas condensate is the part of the gas from a producing well which is separated into liquid phase, consisting of light petroleum components.

The term "cryogenic" describes in this relation a thermally isolated system arranged for handling a gas being cooled down to its liquid phase. The liquid here is LNG. The isolation usually consists of vacuum combined with ordinary isolating material.

By "LNG pipe" pipes being cryogenic are meant, and may comprise pipes with several parallel channels or concentric channels, provided with isolation and possible return channels arranged outside of the main channel. LNG pipes may be stiff or flexible as defined below.

By "rigid LNG pipes" pipes are meant which are no more flexible than the occurring change of shape due to pressure or temperature expansion during use.

With the term "flexible LNG pipe" an LNG pipe is meant being arranged for and which repeatedly may be bent to a smallest radius of bending of e.g. 3 metres. Such flexible LNG pipes are usually provided with corrugated walls of austenitic steel.

An LNG tank vessel is a tank vessel with cryogenic tanks, usually spherically shaped, arranged for transporting LNG.

"STP" and "STL" are submerged moorage- or production loading buoys.

LNG

Methane arrives in gas phase from a gas producing petroleum well and must be condensed in a condensing plant to be brought into liquid phase as LNG. LNG has little volume with respect to the methane gas, and may be handled under low pressure. All heat energy supplied to LNG may lead to boiling and thus loss of methane gas if the gas is not reliquefied. LNG must thus be handled cryogenically during storage and transport, i.e. that tanks, pipes, swivels and valves must be thermally isolated. During LNG production at sea this liquid gas must be transferred to an LNG tank vessel which brings the LNG load ashore to separate tank devices arranged for receiving LNG.

Gas condensate.

Gas condensate consists of other lighter hydrocarbon fractions which must be stored in ordinary tanks separate from the cryogenically stored LNG. Normally the gas condensate must be transported at ordinary tank vessel and may not be transported at LNG tank vessels. Gas condensate may be transferred via e.g. floating loading hoses or STL systems to tank vessels or other export systems. A floating loading hose arranged for being stored or mooraged along the FPSO vessel while not in use for transfer of liquid load, e.g. condensate, is described in Navion's patent application NO 19980431, filed 30.01.1998.

Known Production/export Systems

FIG. 12 illustrates a known solution for LNG production and export which implies storage of a very large volume of LNG on board the FPSO vessel's LNG tanks, and fast offloading to a tank vessel. The large storage volume contributes to the FPSO vessel's displacement and implies generally high construction, operating and maintenance costs. The large storage volume demands a volume which could rather have been utilized for other production processes or storage of other petroleum fluids. LNG tank vessels are already available, and they are less specialized than FPSO vessels, and may thus represent a more economic solution for intermittent storage during production of LNG at the field.

Known LNG Transfer Systems

Due to the known moorage device's limitations, and in order to keep safe separation, preferably 100-150 metres between the FPSO vessel and the tank vessel, known LNG pipes must be long. Existing solutions for LNG transfer to LNG tank vessels imply use of stiff transfer pipes typically 16" (40 cm) inner diameter, and relatively fast transfer to a LNG tank vessel. The known systems for LNG transfer with 16" pipe implies e.g. loading of 135000 $m^3$ of LNG during about 12 hours, i.e. 10000 $m^3$/hour. Such long transfer pipes arranged in a crane boom are heavy, stiff and difficult to handle and are often damaged by connection or disconnection, or break during transfer. Moorage and load transfer under demanding operating conditions is difficult to perform due to the mechanical loads such a transfer pipe would exerted to.

A mooring system comprising hawsers from the FPSO vessel's stern to the LNG vessel's bow in cooperation with about 40 to 50 tonnes constant force aftwards from the tank vessel propulsion engine in order to keep a very close, still tensioned mooring between the FPSO vessel and a tank vessel, is described in Navion's patent application NO 998 0579 filed 10.02.1998, of which this application claims priority. A support vessel which would otherwise be present anyway for handling of loading hoses, moorings etc., may replace the aftward force from the tank vessel's propulsion engine. The combination of a close and still tensioned mooring position facilitates transfer of ordinary liquid load, preferably gas condensate, through the floating loading hose to a midship manifold or a bow manifold on an ordinary tank vessel, but also launches the possibility of LNG load transfer via a flexible LNG pipe extended between the stern of the FPSO vessel and the bow of an LNG tanker. This flexible LNG pipe may either hang freely and dry between the vessels, be held e.g. on sheaves by means of a support wire extended between the vessels, or running via the sea.

A need therefore exists of a system being able to handle a continuous production of both a large volume of LNG and a smaller proportion of gas condensate, and which may export these two products with each their different and special demands for storage, handling and load transfer, preferably to two different kinds of vessels, by means of two different load transfer systems.

The system which here is being applied patent for, represents a unitary solution for several of the above mentioned problems of technical, operational and logistic nature.

Reference to the Set of claims; Definition of the Invention

The Invention According to claim 1

The solution to the above mentioned problems consists of a system for production, storage and export of liquid natural gas (LNG) from an FPSO vessel with an LNG liquefaction plant, with the novel trait by the invention is the combination of the following points:

- an LNG buffer tank on the FPSO vessel, with buffer storage capacity for temporary storage of the continuously produced LNG during the absence of an LNG tank vessel,
- a mooring device arranged for short separation moorage between the stern of the FPSO vessel and the bow of an LNG tank vessel,
- a cryogenic transfer device arranged between the FPSO vessels stern and an LNG tank vessel's bow, comprising a flexible LNG pipe and arranged for consecutive transfer of produced LNG, and
- at least one or more LNG storage tanks in an LNG tank vessel, arranged for being filled continuously via the cryogenic transfer device until the desired degree of filling of an LNG tank vessel is achieved.

The Invention According to Claim 19

The invention comprises also a method for floating production, storage and export of liquid natural gas (LNG) by means of a system according to claim 1, with the new and inventive is a repeated series of the following steps:

a) moorage of an LNG vessel's bow to an FPSO vessel's stern by means of a mooring device arranged for short separation moorage, b) connection of a cryogenic transfer device, arranged for continuous transfer of produced LNG arranged by the FPSO vessels stern, to an LNG tank vessel's bow, c) consecutive transfer of the continuously produced LNG from the LNG liquefaction plant via the cryogenic transfer device (4) to the LNG storage tanks on board an LNG tank vessel, until the desired degree of filling of an LNG tank vessel is achieved, d) disconnection of an LNG tank vessel, simultaneously with e) continuous production and temporary storage of the produced LNG in the LNG buffer tank on board the FPSO vessel, f) moorage of an LNG tank vessel as in point (a) and connection of an LNG tank vessel to the FPSO vessel via the cryogenic transfer device and discharging of the LNG buffer tank to an LNG tank vessel simultaneously with the resumption of consecutive transfer of produced LNG to an LNG tank vessel.

The Invention According to claim 22

The invention also concerns a method for floating production, storage and export of liquid natural gas (LNG) and gas condensate by means of the system according to claim 16, with the novel and inventive consisting of a repeated sequence of the following steps:

a) moorage of an LNG tanker's bow to the FPSO vessels stern by means of a moorage device arranged for short separation moorage, b) connection of a transfer device arranged for transfer of produced LNG arranged by the FPSO vessel's stern, to an LNG tank vessel's bow, c) consecutive transfer of the produced LNG from the LNG liquefaction plant via the cryogenic transfer device to the LNG storage tanks on board an LNG tank vessel, until a desired degree of filling of the LNG storage tanks are achieved, d) storage of the produced gas condensate in gas condensate tanks on board the FPSO vessel, e) disconnection of the LNG tank vessel simultaneously with continued consecutive production and temporary production to the LNG buffer tank on board the FPSO vessel and either f) during an LNG tank vessel's absence or disconnected state, to connect together an ordinary tank vessel with the FPSO vessel and transfer of the gas condensate via a separate transfer device to tanks in a tank vessel, or g) moorage of and connection of an LNG tank vessel to the FPSO vessel via the cryogenic transfer device and discharging of the LNG buffer tank to an LNG tank vessel.

The Invention According to claim 23

The invention also consists as a device for transfer of liquid natural gas (LNG) from an FPSO vessel to a tank vessel by means of a cryogenic transfer device, with the new and inventive is that it comprises (a) a crane boom arranged by the stern of the FPSO vessel, comprising a relatively rigid LNG pipe, which boom is rotatable about a horizontal axis, with the LNG pipe being connected with (b) at least one flexible LNG pipe, arranged for connection to (c) a connector arranged in the bow of the LNG tank vessel.

With a preferred embodiment of the invention one may have smaller FPSO vessels with equally large production capacity as FPSO vessels designed according to the known art.

The system of the invention implies that as utilization of parts of the saved volume in the FPSO vessel by consecutively transferring the storage of the production of LNG to an LNG tank vessel being mooraged the FPSO vessel, larger storage tanks for gas condensate may be arranged in the FPSO vessel, arranged for storing the usually smaller proportion of gas condensate being produced, and arrangements for transfer of the gas condensate to an ordinary tank vessel. The invention comprises a method for transferring the stored gas condensate from the tanks of the FPSO vessel via a floating loading hose to a separate tank vessel arranged for transporting such gas condensate. Preferably this gas condensate is transferred while the LNG tank vessel is absent from the FPSO vessel.

Advantages by the Invention

The purpose with such a system, a method and a device as mentioned above and according to the set of claims, is to have an FPSO vessel with small storage volume of LNG, with small moorage separation to an LNG tank vessel, with both lying in tandem with the bow toward the weather. The FPSO vessel has continuous production of LNG and a consecutive and relatively slow transfer of LNG takes place via a cryogenic flexible pipe from the FPSO vessel's stern to the bow of the LNG tank vessel. The LNG tank vessel acts as a temporary storage for LNG. The LNG transfer is continued until a desired degree of filling of the LNG tank vessel is achieved. The LNG buffer tank on board the FPSO vessel is therefore filled up normally during the short period from the interrupting of the LNG transfer when the LNG tank vessel goes to the shore and deliver at a receiving plant, and until an other LNG tank vessel is back, mooraged and connected to the FPSO vessel again, before the LNG buffer tank becomes full. In the wider perspective opened by the invention, an ordinary tank vessel for condensate may be connected to the FPSO vessel via a floating loading hose, and receive the gas condensate which has been produced during a longer period. During the absence of the LNG tank vessel the continuously produced LNG is stored temporarily in the LNG buffer tank on board the FPSO vessel. When the ordinary tank vessel eventually is disconnected from the floating loading hose and leaves the FPSO vessel, an LNG tank vessel is mooraged for consecutive storage of the LNG production simultaneously with the LNG buffer tank's content being transferred to the LNG tank vessel. With the system and the method according to the invention the production of LNG and condensate may happen continuously, and both products may be stored and exported in a way which is more to the purpose and economic than according to the known art.

Additional inventive traits are evident from the description and the dependent claims.

Description of the Drawings

The invention will be described below, with reference to the corresponding Figures with reference numerals to device details according to the invention, with FIGS. 1*a* and 1*b* show perspective illustrations of a system according to the invention with:

1*a*) an FPSO vessel and an LNG tank vessel interconnected by a flexible LNG pipe extended between the vessel, with the LNG tank vessel mooraged to the FPSO vessel's stern,

Figures 1A, 2A:
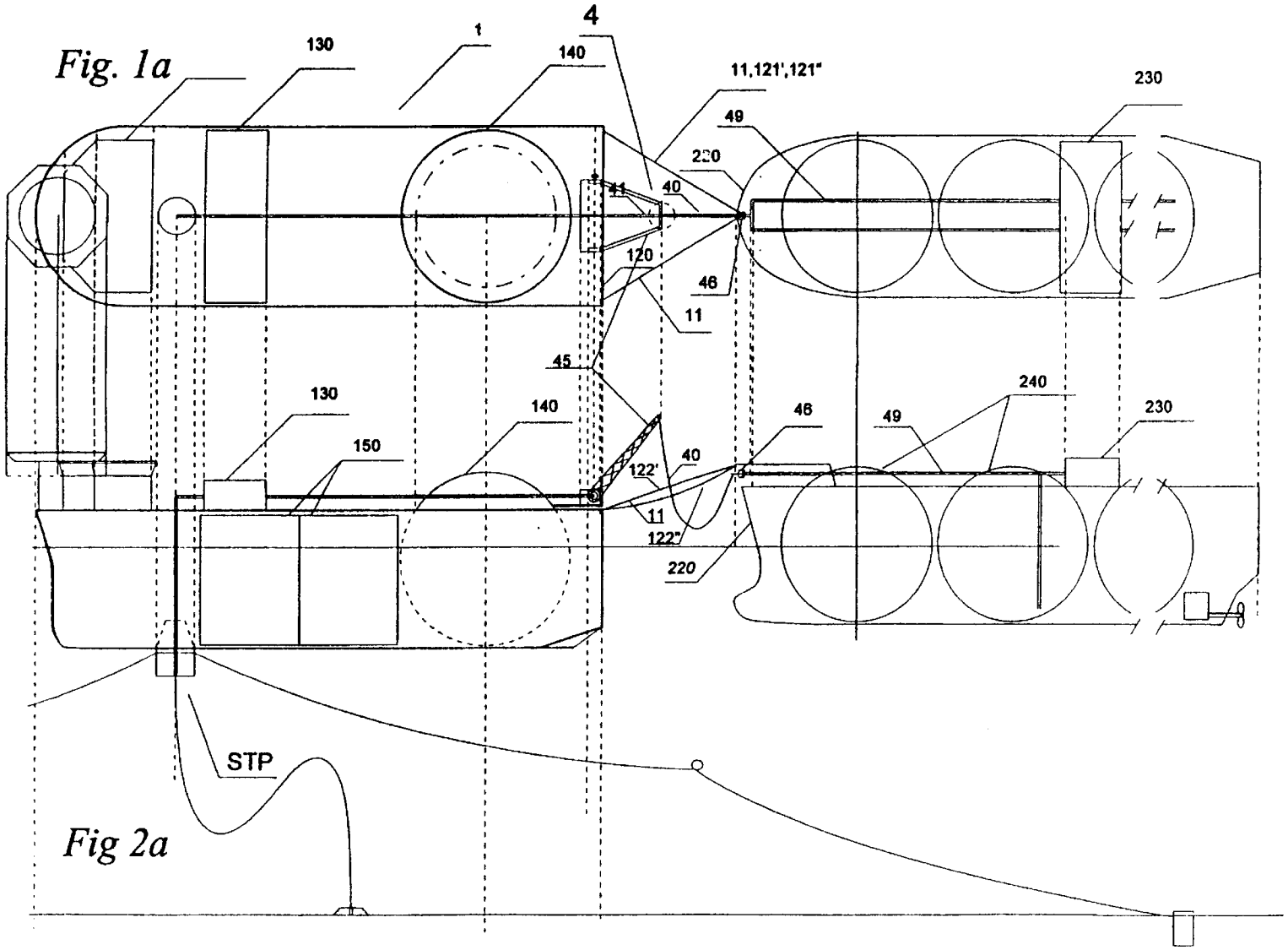

1*b*) an FPSO vessel and an ordinary tank vessel interconnected by a floating loading hose extending between the vessel, and with the tank vessel mooraged to the stern of the FPSO vessel, FIG. 2*a* displays in a vertical long section the system with an FPSO vessel connected to an LNG tank vessel.

Figures 1B, 2B:
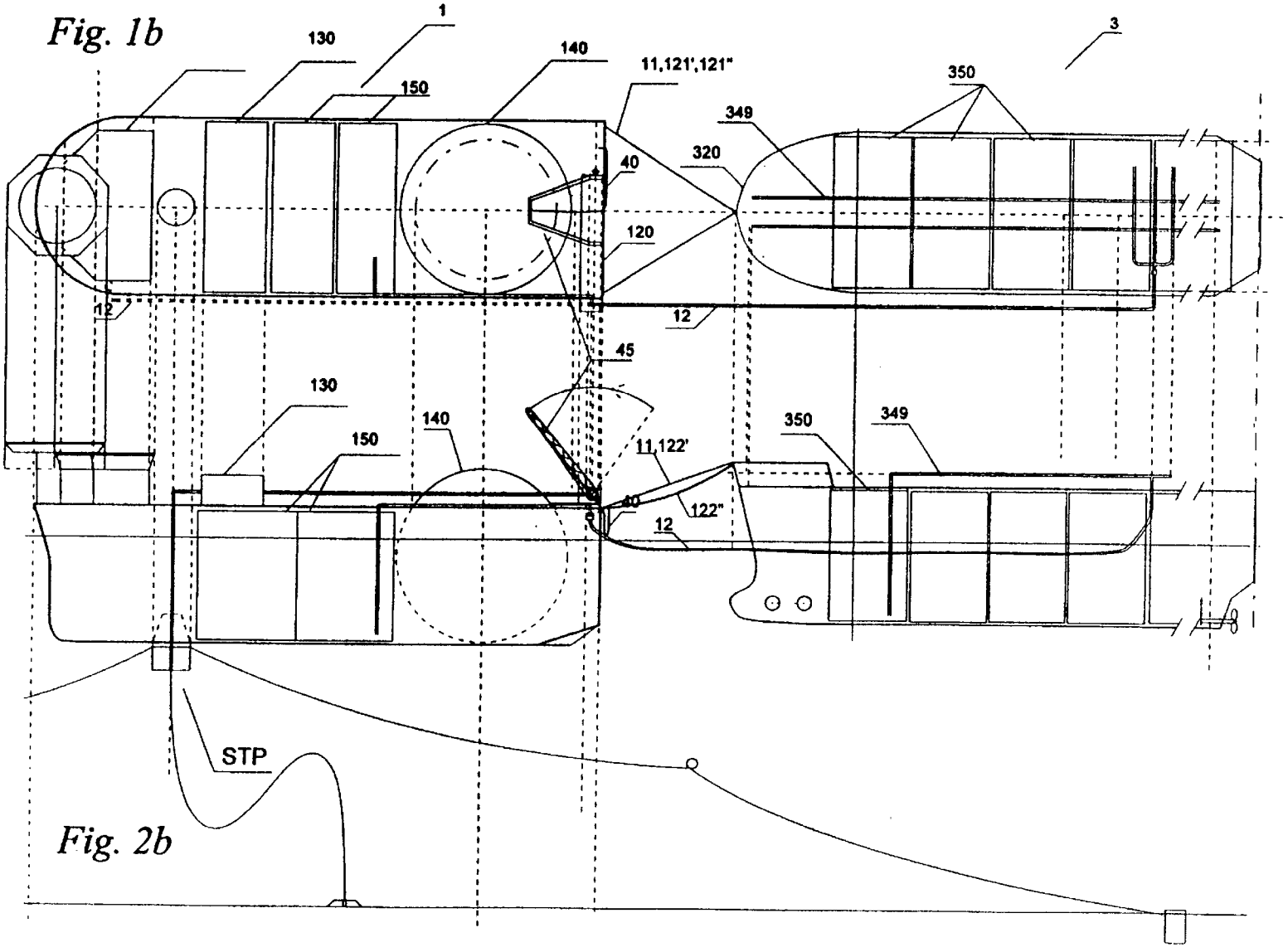

FIG. 2*b* displays in a vertical long section the system with an FPSO vessel connected to a gas condensate tank vessel.

Figure 3A:
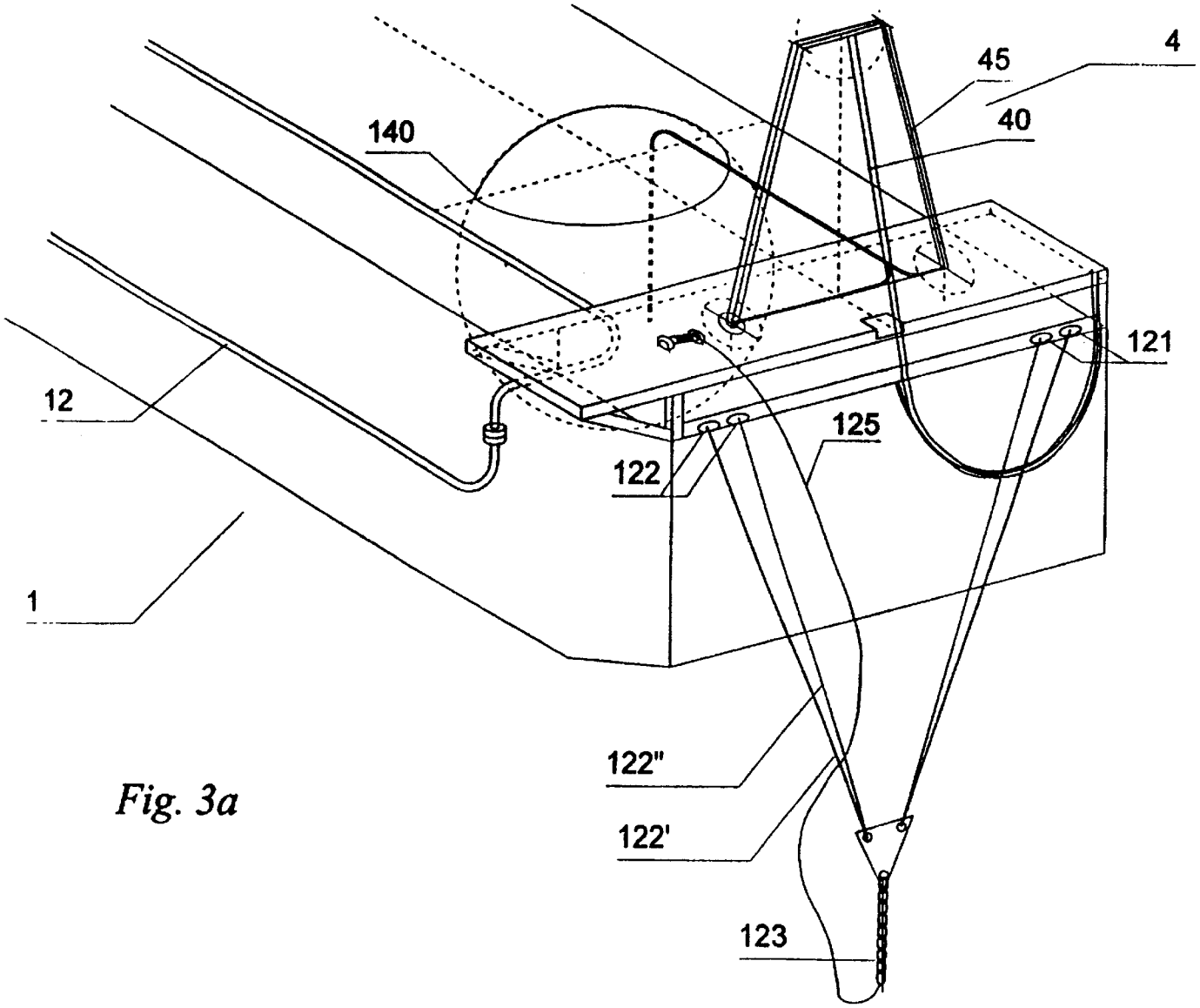

FIG. 3*a* shows in perspective an illustration of a possible embodiment of a transfer device comprising a crane boom with a flexible LNG pipe for transfer of liquid natural gas LNG.

Figures 3B, 4:
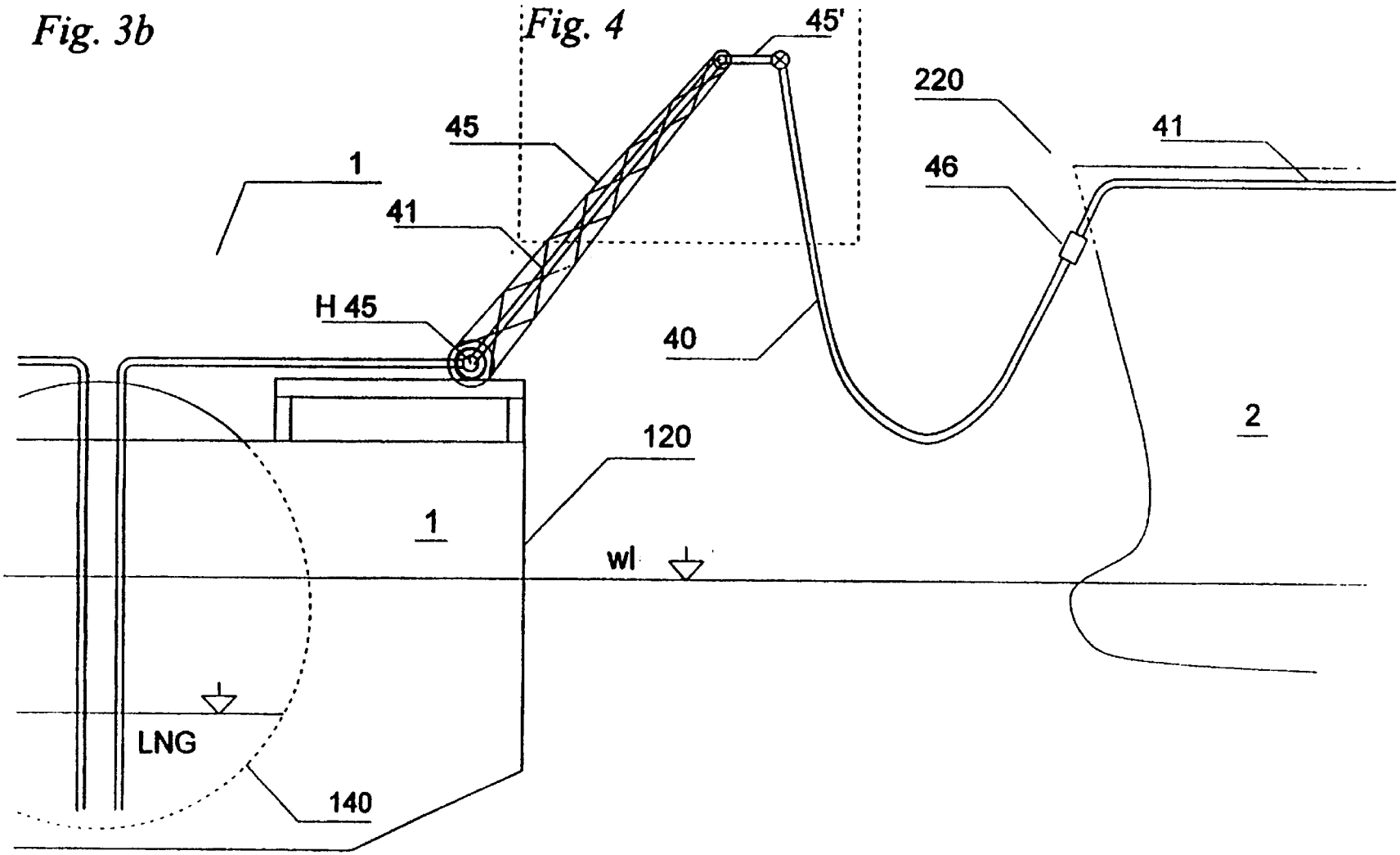

FIG. 3*b* displays a simplified illustration of the transfer device for LNG arranged between the stern of an FPSO vessel and the bow of an LNG tank vessel, and a simplified illustration of an LNG buffer tank.

Figure 3C:
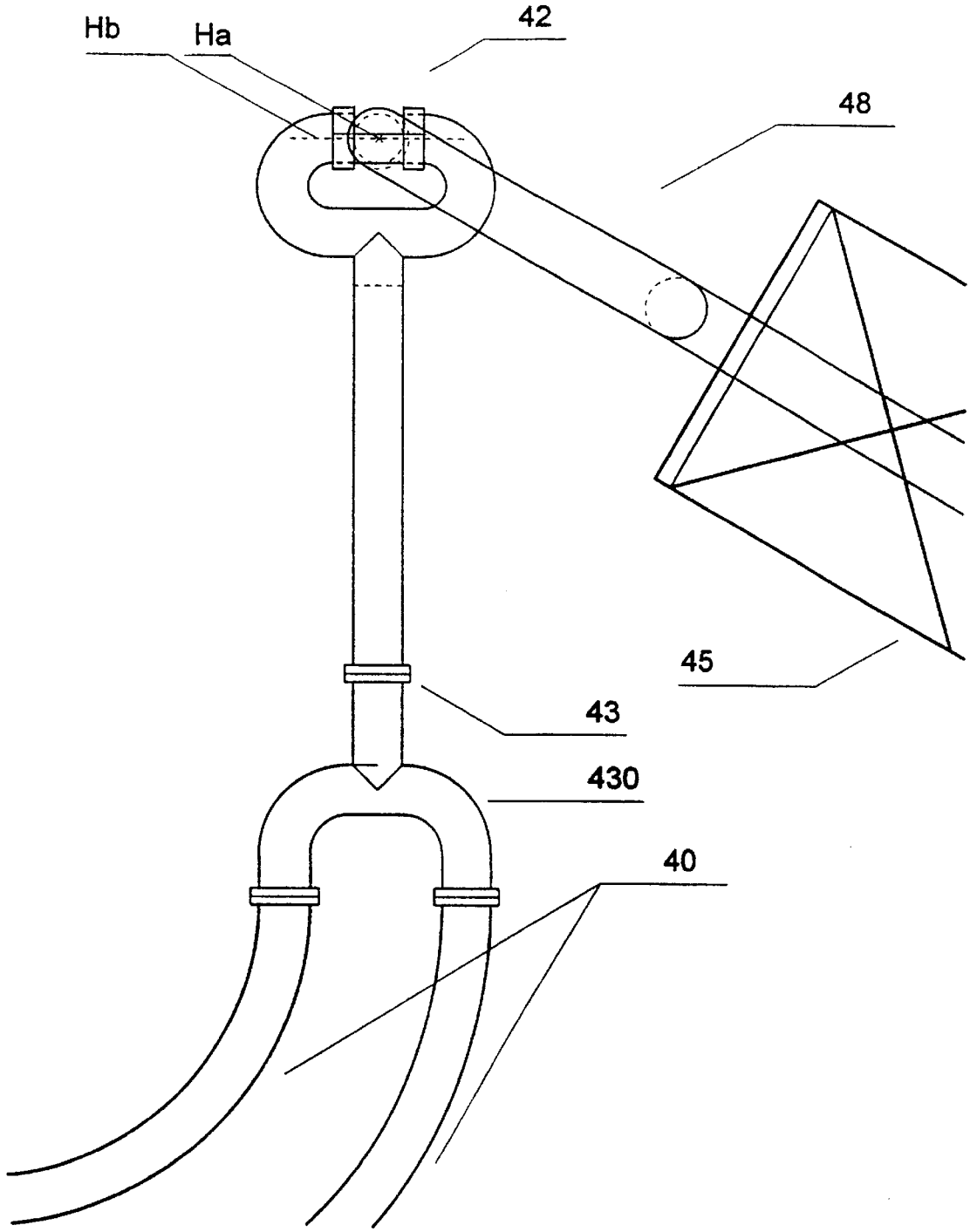

FIGS. 3*c* and *d* display alternative embodiments of articulated LNG pipes and swivels of a flexible LNG pipe in the transfer device for LNG.

Figure 3D:
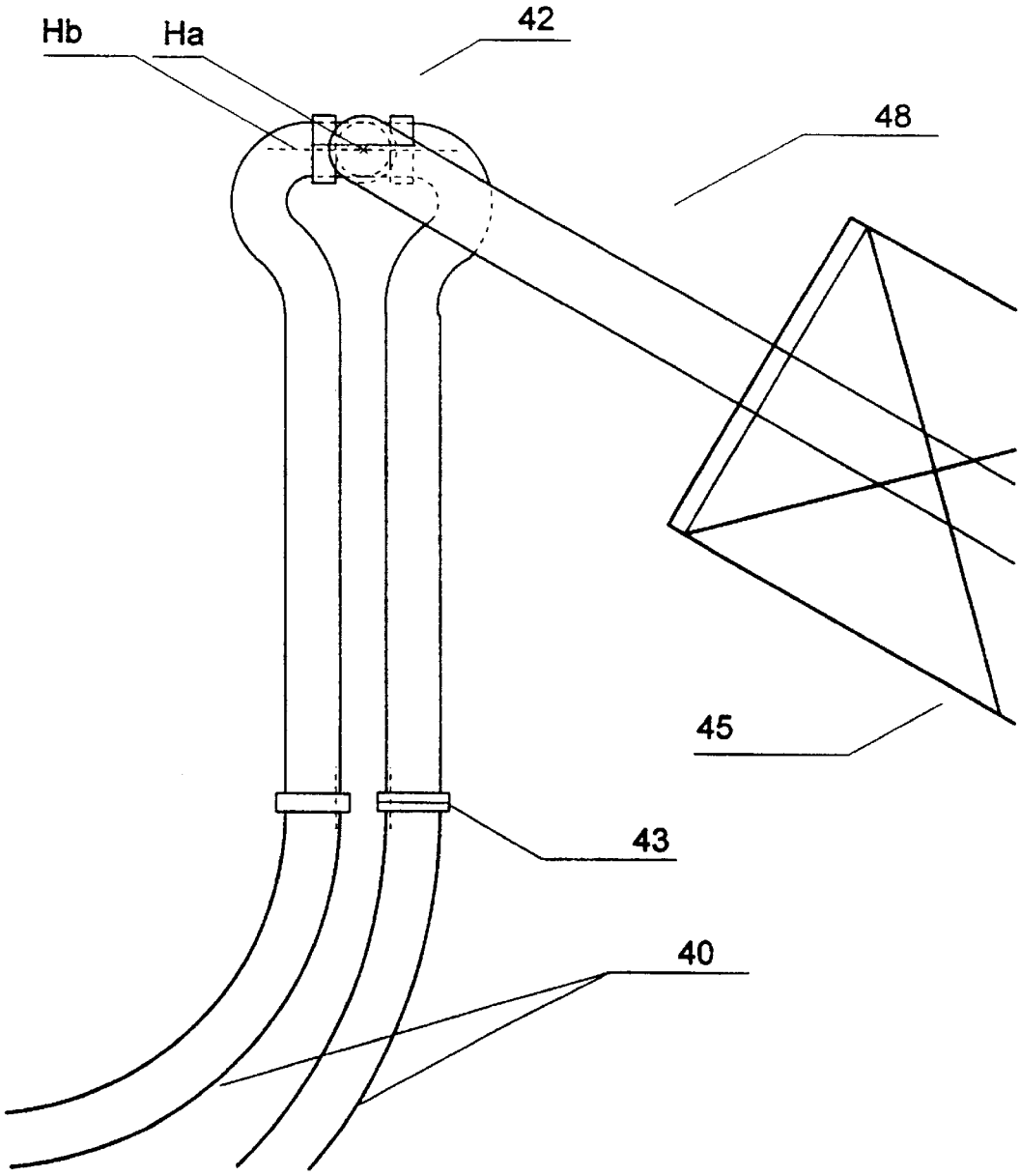
Figure 3E:
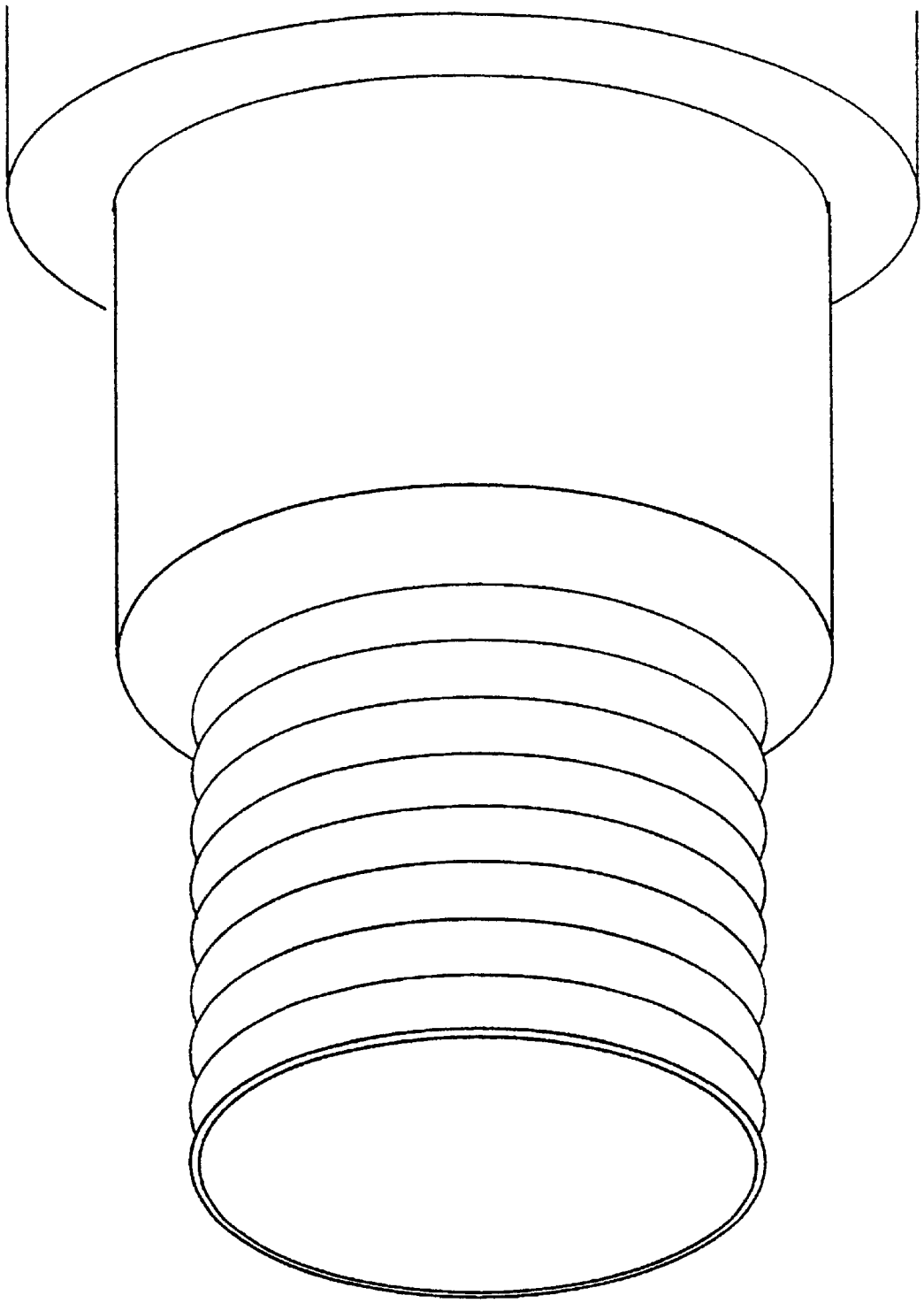

FIG. 3*e* displays a simplified illustration of a preferred embodiment of a cryogenic flexible LNG pipe.

FIG. 4 displays a principle illustration of an embodiment of a jib of a crane boom in the transfer device.

Figure 5:
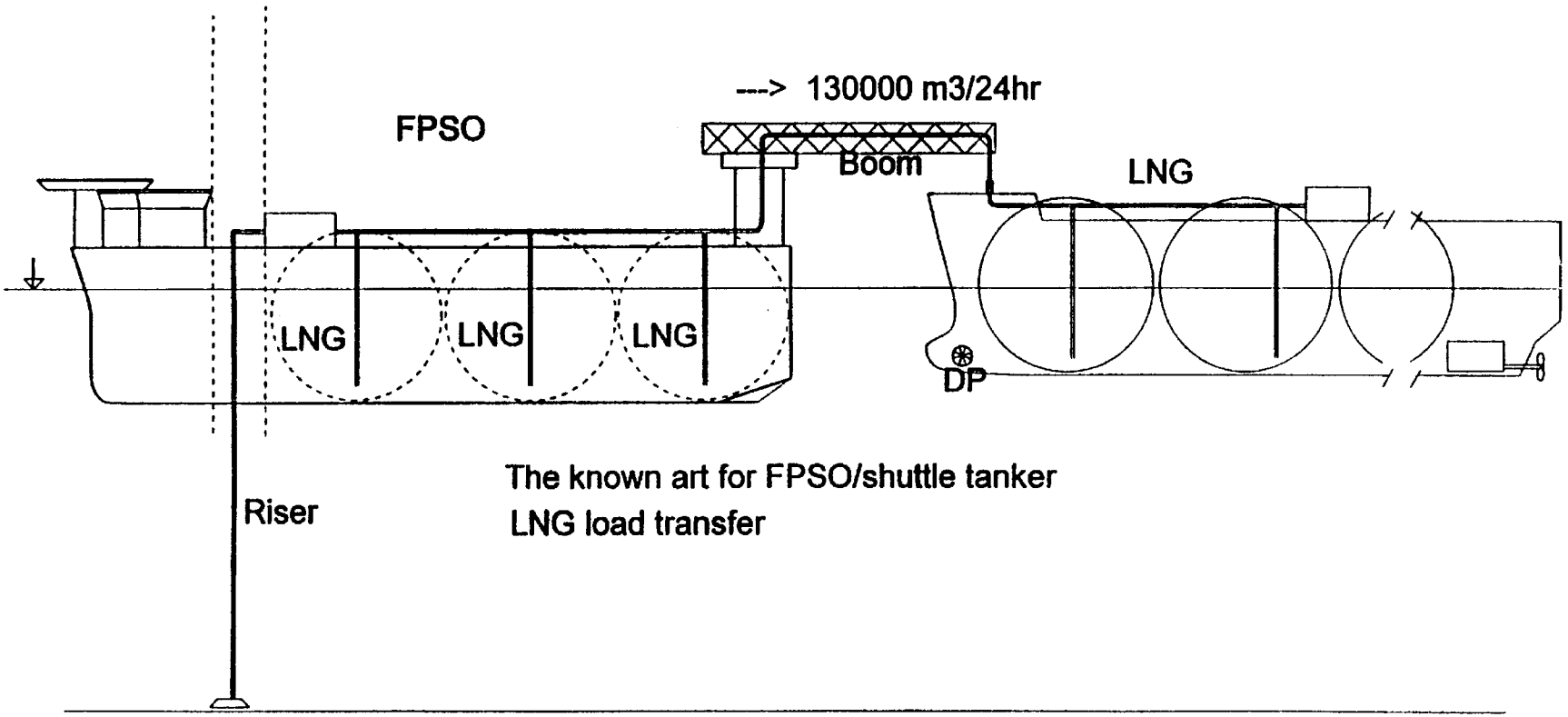

FIG. 5 illustrates how LNG transfer is done by means of a rigid cryogenic pipe in a boom according to the known art.

Figure 6:
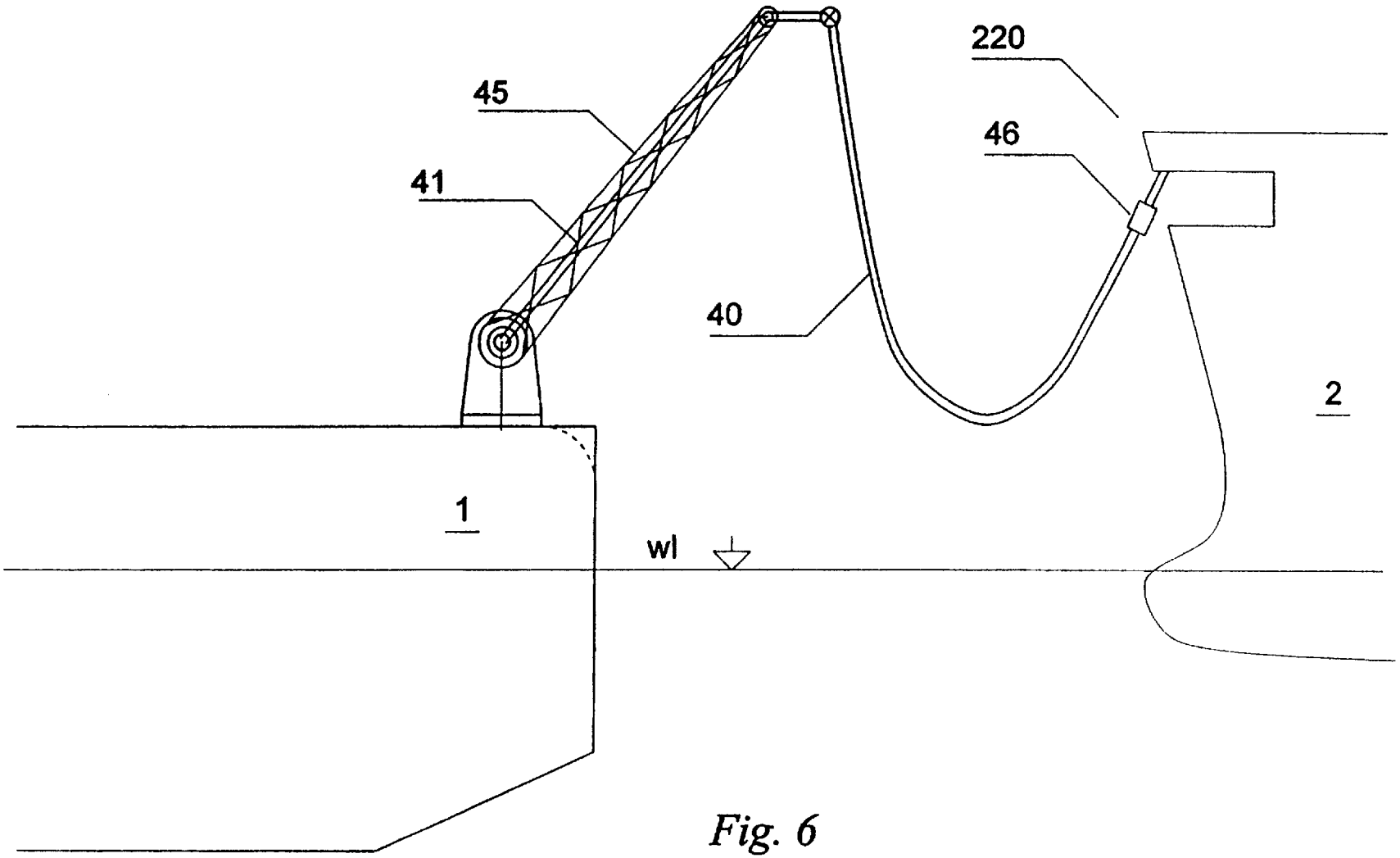

FIG. 6 illustrates simplified a possible embodiment of the transfer device for LNG.

Figure 7:
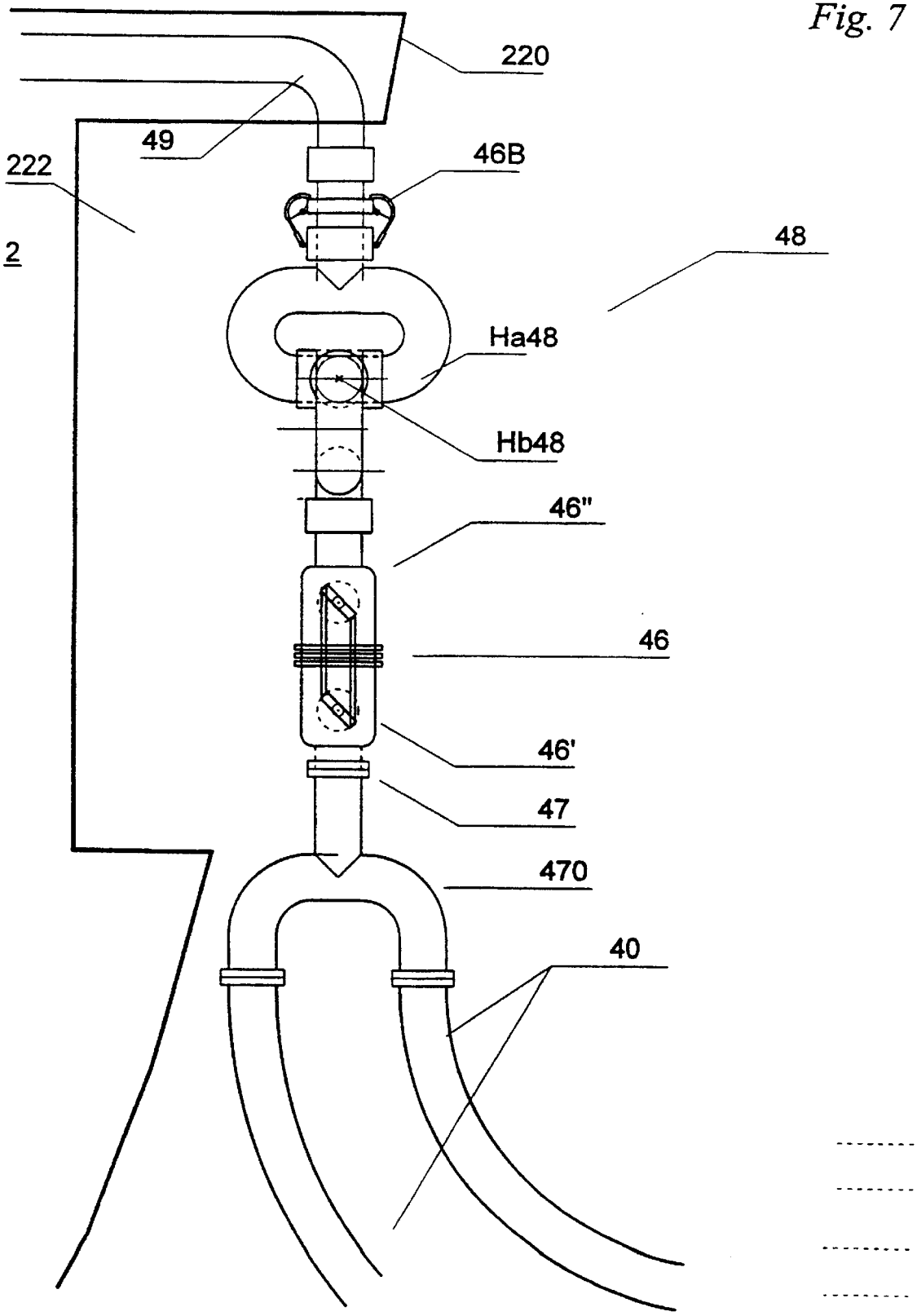

FIG. 7 gives an overview of the pipe details which may be comprised by the transfer device for LNG in the bow of the LNG tank vessel's bow.

FIGS. 8, 9, 10 and 11 illustrate possible embodiments of the transfer device for LNG.

Figure 12:
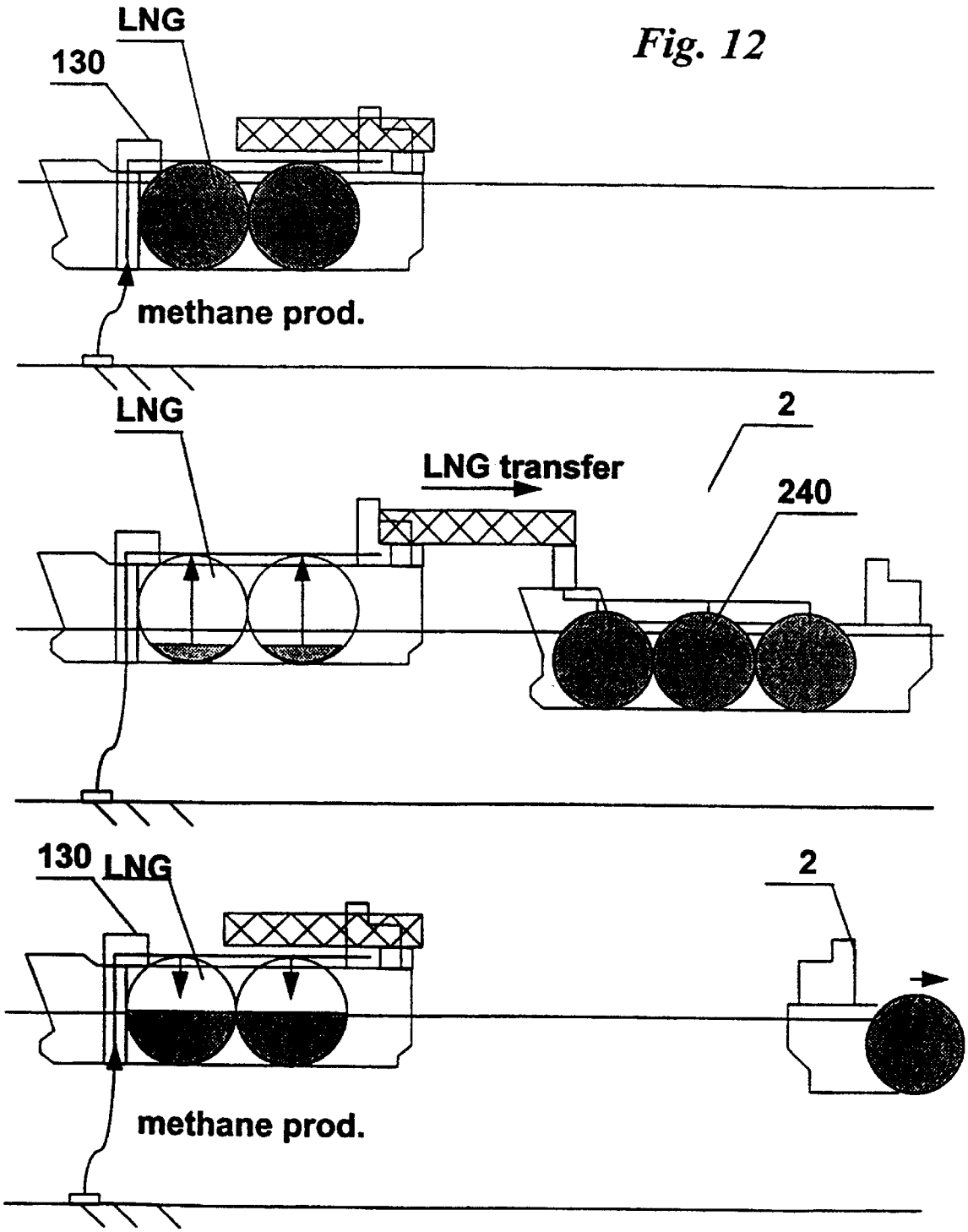
Figure 13:
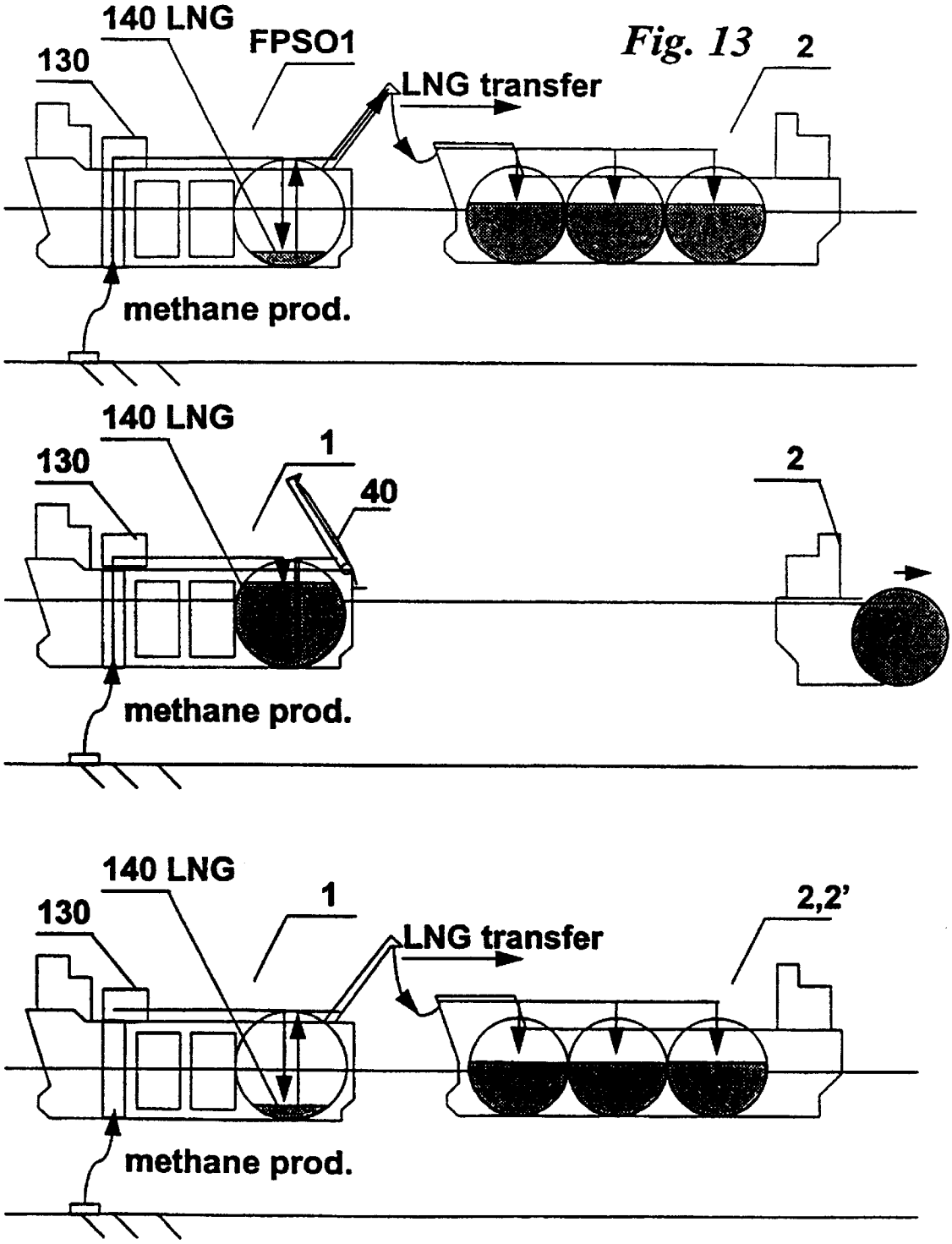

FIGS. 12 and 13 display the system as a whole according to the known art and according to the invention.

DETAILED DESCRIPTION

The Vessels

FIGS. 1*a* and 2*a* illustrate the invention comprising an FPSO vessel 1 lying at sea as it produces petroleum fluids. The vessel 1 lies in the illustrated preferred embodiment anchored by means of a so-called Submerged Turret Production buoy, here called an STP buoy. The FPSO vessel 1 has a methane liquefaction plant 130 condensing or liquefying methane to LNG. The FPSO vessel lies, in a preferred embodiment of the method, at any time with the bow on the weather, and thus export to an LNG tank vessel 2 happens leewards of the stern of the FPSO vessel. FIGS. 1*b* and 2*b* show an other tank vessel 3 with ordinary tanks which make part of the system and is applied for export of gas condensate. As the LNG tank vessel 2 or the tank vessel 3 thus also will lye with the bow on the weather, the relative side forces between the vessel be minimal considered over time.

The LNG B uffer Tank

A spherical buffer tank 140 is arranged (preferably by the stern) of the FPSO vessel 1. In a preferred embodiment of the invention one LNG buffer tank 140 is arranged. In alternative embodiments several LNG buffer tanks 140 may be arranged, but they will herein be referred to together as the LNG buffer tank 140. The LNG buffer tank is arranged for buffer storage of LNG during shorter or longer interruptions of the transfer of LNG to storage tanks 240 in the LNG tank vessel 2. The interruptions in transfer of LNG occur while the tank vessel 2 leaves the production vessel 1 in order to go to receiving plants for LNG, e.g. onshore. The LNG buffer tank 140 may also be applied if the transfer of LNG must be interrupted during bad weather. The LNG buffer tank 140 is equipped with LNG transfer pipes leading to a transfer device 4 for transfer of LNG to the LNG tank vessel 2. The LNG buffer tank 140 will also be applied if the other tank vessel 3 must take over the place at the FPSO vessel's 1 stern 120 for transfer of gas condensate by means of a floating loading hose 12 arranged at one of either starboard side 121 or port side 122 of the stern 120, as shown in FIG. 2*b*. The loading hose 12 is arranged for connecting to a midship manifold 312 to gas condensate tanks 340 in the ordinary tank vessel 3. The transfer of gas condensate may also be performed via an ordinary bow manifold on the tank vessel 3. The floating loading hose 12 will in a preferred embodiment be arranged on a pipe swived as described in Navion's patent application NO 19980431 filed 30.01.1998 which this application claims priority from. The floating loading hose 12 is in the preferred embodiment arranged for, while not being applied for load transfer, to be taken in tow from a aftwards directed position to a forwards directed position and mooraged or elevated from booms arranged along the FPSO vessel's starboard or port side, forwards from the pipe swivel. Thus the floating loading hose is stored in a safe way, and it will not lie in the way of vessels behind the FPSO vessel 1.

Cryogenic Transfer

A cryogenic transfer device 4 comprising a flexible LNG pipe 40 is arranged between the stern end 120 of the FPSO vessel 1 and the bow 220 of an LNG tank vessel 2. Cryogenic pipes, valves and pumps (not shown) are provided for transport of LNG from the liquefaction plant 130 via the LNG buffer tank 140 to the transfer device 4. Storage tanks 240 may be arranged on board the LNG tank vessel 2 in ordinary manner. Parts of the transfer device 4 is arranged in the bow 220 of the LNG tank vessel 2, especially a connector 46 connecting the flexible LNG pipe 40 to LNG pipes 49 leading to the LNG storage tanks 240.

The Reliquefaction Plant

An LNG reliquefaction plant 230 is arranged on the LNG tank vessel 2 as shown in FIGS. 1A and 2. The reliquefaction plant 230 receives boiled-off methane gas from the LNG pipelines and the storage tanks 240 on board the LNG tank vessel 2 and reliquefies the methane gas to LNG, whereafter the LNG liquid is returned to the LNG storage tanks 240, or to the LNG buffer tank 140 of the FPSO vessel 1 via separate return channels in the transfer device 4 and the flexible LNG pipe 40.

The Mooring

The small separation mooring between the vessel is essential for the embodiment of the invention. FIGS. 1*a* and 1*b* show how the LNG tank vessel 2 or 3 is lying with the bow 220 mooraged to the FPSO vessel's 1 stern part 120. In order to keep a safe separation and to keep a most possible straight-line tandem position between the vessel 1 and the vessel 2 it is suitable to let the LNG tank vessel's 2 main propeller draw aftwards with a force aftwards of about 40 to 50 tonnes (400000–500000 N) or according to the need. An alternative to keep safe separation between the vessels 1 and 2 and at the same time tension in the mooring hawsers may be to apply a tender (not shown) by the stern of the LNG tank vessel 2, thus drawing evenly rearwards. The transfer device 4 with the flexible LNG pipe 40 then runs centrically from the middle of the FPSO vessel's 1 stern 121' to the LNG tank vessel's 2 bow 220.

In a preferred embodiment of comprises the mooring device 11 comprises at least one set of mooring hawsers 121', 122' extending from the FPSO vessels respectively starboard and port side 121, 122 of the FPSO vessels stern 120, to the LNG tank vessel's bow 220, with the hawsers 121', 122' constituting two essentially equal sides of an isosceleles triangle (120, 121', 122') with the stern 120 as the base line. Additional mooring hawsers 121", 122W are in the preferred embodiment of the invention arranged in parallel with the hawsers 121', 122, but with more slackening, or with less tension than the hawsers 121', 122', arranged so that if one of the hawsers were to become broken, then the moorage loaf would not fall on the transfer device's 4 flexible LNG pipe 40, but rather on the mooring hawsers 121", 122". With a separation of 50 metres between the vessels, a width of 45 metres over the stern end 120 between the fixation points of the hawsers 121', 122' and an aftward drawing force of 50 tonnes, the sidewards directed holding force on the bow 220 becomes about 11,25 tonnes. This sidewards directed keeping force gives improved conditions for connecting and transfer via the flexible LNG pipe 40.

A messenger line 125 is shown in the mooring hawser. During moorage of a tank ship a tender vessel (not shown) may bring the messenger line over to the LNG tank vessel 2 lying at safe distance, typically 150 to 300 metres, behind the FPSO vessel 1. By means of the messenger line the LNG tank vessel 2 will be able to carefully winch itself forwards toward a desired mooring position, about 50 metres from the FPSO vessels' 1 stern 120.

Mooring Distance

In a preferred embodiment of the invention the LNG tank vessel is moored with a separation less than 140 m between the FPSO vessel's 1 stern 120 and the LNG tank vessel's 2 bow 220. In an additionally preferred embodiment this separation is less than 75 metres. In a most preferred embodiment this separation is less than 60 metres and larger than 30 metres. Moorage of the LNG tank vessel 2 to the FPSO vessel 1 and connection of the flexible LNG pipe 40 may, according to a preferred embodiment of the invention, happen at operation conditions at least up to HS=3,5 m, and load transfer may after connection happen at least up to Hs=4,5 m.

The Transfer Device

According to the invention there is arranged a cryogenic flexible pipe 40 arranged to run essentially centrally from the middle point of the stern 120 of the FPSO vessel 1 to the bow 220 of the LNG tank vessel 2 as shown in FIG. 1*a*. The flexible LNG pipe 40 may run partly through the sea or run along a support wire (not shown) by means of a sheave system, or it may hang freely between the crane boom 45 and the bow 220 without touching the sea. The flexible LNG pipe is in a preferred embodiment of the invention arranged in the end of a crane or boom 45 shown in FIG. 3*b*, is comprising a rigid cryogenic pipe 41, of which boom 45 is rotatable at least about a horizontal axis $H_{45}$. A connector 46 in the LNG tank vessel's 2 bow 220 is connected to a pipe manifold or pipe 49 leading further to the LNG tanks 240. The crane 45 gives the flexible LNG pipe 40 in its lowest point sufficient height above the sea to avoid being hit by waves. The crane 45 may take up slow changes of the ships' draught as the load transfer progresses. The crane 45 makes possible a safe storage of the flexible LNG pipe 40, and facilitates the transfer of this flexible LNG pipe 40 to the tank vessel 2. The end of the crane 45 may be designed as a jib 45' with corresponding needed swivels (shown in FIG. 4) rotatable about a port-to-starboard athwartships oriented horizontal axis. The crane or boom 45 may be an A-frame crane arranged to compensate for the relative vertical movements between the vessel 1 and the LG tank vessel 2 due to the slow elevation caused by the change of load condition due to unloading of the tank 140 in the FPSO vessel 1 and the slow change of load condition for the LNG tank vessel 2 during the filling of about 130000 $m^3$ LNG. The crane boom 45 may also in an alternative embodiment be rotatable about a vertical axis $Z_{45}$. The transfer device 4 comprising the flexible LNG pipe 40 runs in a vertical plane between the middle of the FPSO vessel 1 stern 120 to the middle of the LNG vessel's bow 220, centrally and not in touch with the mooring hawsers.

Details for Transfer by the Bow of the LNG Tank Vessel

In a preferred embodiment illustrated in the FIGS. 3*c* and 3*d*, two parallel flexible LNG pipes 40 are arranged between the boom 45 and the connector 46, also shown in FIGS. 6 and 7. The connector 46 is in a preferred embodiment a part of a pipe arrangement arranged in a bow port 222 in the bow 220 of the vessel 2, illustrated in FIG. 7. The flexible LNG pipes 40 may be joined at a junction ("trouser junction") 470 to one main course. The junction 470 leads further to a swivel 47 being rotatable about an axis parallel with the approximately vertical main axis of the pipe arrangement. The swivel 47 is further connected to a connector 46 with a ball valve 46' arranged on the swivel's 47 and the flexible LNG pipe 40 side of the connector 46, and a corresponding ball valve 46" arranged at the vessels's 2 side of the connector. A second LNG pipe articulation 48 is arranged preferrably above the ball valve 461, and the connector 46. Above the second LNG pipe articulation 48 there is in a preferred embodiment an emergency disconnector 46B which in contrary to the connector 46 is not arranged for ordinary connection and disconnection. In an alternative embodiment the emergency disconnector 46B constitutes an integrated part of the connector 46 where the emergency disconnector 46B is arranged for rapid disconnecting. In an alternative embodiment there may be arranged a swivel on the pipe arrangement between the emergency disconnector 46B and the LNG pipe 49. This rigid LNG pipe leads further to the LNG tanks 240 via an ordinary cryogenic pipe system.

Details for Transfer by the End of the Crane 45

By the end of the LNG pipe 41 there is arranged a first LNG articulation 42 being rotatable about two axes $Ha_{42}$, $Hb_{42}$ and arranged between the LNG pipe 41 and the flexible LNG pipe 40. A first LNG pipe swivel 43 is arranged between the LNG pipe 41 and the flexible LNG pipe 40. A first LNG pipe swivel 43 is also arranged between the LNG pipe 41 and the flexible LNG pipe 40. The junction or manifold articulation 430, 470 may be arranged at both ends of the at least two flexible LUG pipes 40 between the swivels 43 and 47 by application of two or more parallel LNG pipes 40 between the vessels. FIG. 3*d* shows an alternative preferred embodiment of the LNG pipe double articulation 42 arranged with two separate courses being connected to each their flexible LNG pipe 40.

Liquefaction Plant

The FPSO vessel 1 comprises in a preferred embodiment a liquefaction plant 130 to convert natural gas, preferrably methane, having whatever temperature at any time while arriving via a riser pipe from a petroleum bearing well, to liquid natural gas LNG with a boiling point of about minus 164° C. All heat contributed to this liquid natural gas will imply boiling and gassing with natural gas as a result. Because of this, all transport and storage of LNG must take place cryogenically, best possibly thermally isolated both in pipes, valves, swivels and tanks.

LNG Buffer Tank Size and Function

The LNG liquid must, after condensation in the plant 130 be conducted via LNG pipes to a first LNG tank 140. According to a preferred embodiment of this invention the LNG buffer tank 140 hold between 20000 $m^3$ and 80000 $m^3$. By a certain LNG buffer tank volume it may be advantageous or imperative to distribute the volume in two or more tanks, and even if more tanks are arranged they will here be referred to collectively as "the LNG buffer tank 140". The LNG buffer tank 140 is arranged to take up the continuous production of LNG while the LNG tank vessel 2 is connected off and leaves for harbour to deliver the charge, and to be drained to the LNG tank vessel 2 when it has returned and been connected to the production vessel 1. The transfer of LNG from the buffer tank 140 to the LNG tanks 240 in the LNG tank vessel 2 takes place simultaneously with the transfer of the produced LNG from the liquefaction plant 130, which in a preferred embodiment is conducted via the LNG buffer tank 140. In this way the LNG buffer tank 140 will never become entirely empty, and never entirely full, except if one should not get any available LNG tank vessel before the LNG buffer tank is entirely filled. The LNG tank vessel may naturally be replaced by another LNG tank vessel 2', also being arranged for storage and transport of LNG. In a preferred embodiment of the invention there will be several LNG tank vessels 2, 2' alternating loading LNG from the FPSO vessel 1, and also other ordinary tank vessels 3 loading condensate from the FPSO vessel 1.

Capacity of the Transfer Device

The export of LNG to the tank vessel 2 takes place according to the invention via a transfer device 4 comprising a flexible LNG pipe 40 being essentially extended between the FPSO vessel's 1 stern part 120 and the LNG tank vessel's 2 bow 220. The flexible LNG pipe 40 is in a preferred embodiment drawn extending in the air and does not touch the sea, but it is possible to let the flexible LNG pipe pass partially through the sea in other embodiments. In a preferred embodiment the flexible LNG pipe 40 has an inner diameter for each of the main channels of 8" (20 cm). In a preferred embodiment the transfer device 4 will comprise two or more flexible LNG pipes 40 as displayed in FIGS. 3*c* and 3*d*. In alternative embodiments each flexible LNG pipe may consist of several parallel main channels, or it may consist of concentric pipes, the one arranged inside of the other, and possibly with return channel arranged for cooling or return of boiled-off LNG. The area of the flexible LNG pipe's 40 main channel becomes about 0,0314 $m^2$ per main course. If a volume V=20000 $m^3$ shall pass through one single flexible LNG pipe 40 in T=24 h=86400 s, 0.23 $m^3/s$ is transferred with a speed of 7.4 m/s. LNG is transferred to the tank vessel 2 with a speed of at least about 7.5 m/s for continually to keep the pace of production of the FPSO vessel 1, if one have one single flexible LNG pipe 40. If pumping LNG in an amount of 31 $m^3$/minute corresponding to a speed of up to 16 m/s, one may thus transfer LNG somewhat more rapidly than the continuous production. In an embodiment with two or more flexible LNG pipes the transfer capacity will be correspondingly larger, or one may reduce the fluid speed in the flexible LNG pipes 40. The FPSO vessel will stand several days and nights absence of the tank vessel 2 without having to stop the production of LNG. The buffer capacity of the tank 140 may also be utilized if the transfer of LNG must be interrupted or the tank vessel 2 must be disconnected due to heavy seas or due to errors in the transfer device 4, or if the transfer device 4 must be shut down for short repair or maintenance.

The Vessels

In a preferred embodiment of the invention there will be several LNG tank vessels available for the system. While one LNG tank vessel 2 goes to harbour for unloading the LNG, an other LNG tank vessel arrives and moorages itself to the FPSO vessel and starts loading LNG via the transfer device 4. The LNG tank vessel has, according to the invention, larger storage capacity for LNG in its tanks 240 than the LNG buffer tank 140 on the FPSO vessel, and according to a preferred embodiment of the invention, a storage capacity of about 130000 $m^3$. The preferred configuration according to this invention implies economic savings both because the FPSO vessel may be constructed relatively modest size of the LNG tank 140 and thus either permit larger deck area and loading room for other petroleum production equipment or to be built smaller than what it otherwise would have been built. Thus building, maintenance and operating costs of the FPSO vessel are saved. The LNG tank vessel 2 is used as store for production until it is full after its continuous and relatively long lasting connection with the FPSO vessel.

After the LNG tank vessel 2 is mooraged by means of the mooring device 11, and the flexible LNG pipes 40 by means of the connector 46, the flexible LNG pipes 40 should be cooled to −164° C. before transfer of LNG is started so that LNG does not boil off methane during the transfer. This may by the preferred embodiment be performed by keeping the ball valve 46' or the ball valve 46" closed, and pump LNG from the FPSO vessel 1 through one of the flexible LNG pipes 40 and let LNG and boiled-off gas return via the junction or "trouser junction" 470 and the other flexible LNG pipe back to the FPSO vessel 1.

Reliquefaction Plant

Both during LNG transfer, and by keeping LNG in the tanks 240, LNG will boil off and evaporate. In a preferred embodiment the LNG tank vessel 2 will have a reliquefaction plant 230 arranged to recondense the evaporated gas from the tanks 240 and from the transfer device 4 comprising the flexible LNG pipe 40. This reliquefaction plant 230 is arranged to return the reliquefied LNG back to the LNG tanks 240 or back to the FPSO vessel 1. With a reliquefaction plant 230 on the vessel 2 one will be able to recondense the boiled-off methane gas arising while one by means of LNG cools down the transfer device 4 and the LNG pipe 49, possibly also tanks 240 before the transfer of LNG is begun. In this way the loss of methane becomes minimal.

Embodiments of the Crane Boom for the Flexible LNG Pipe

Figure 8:
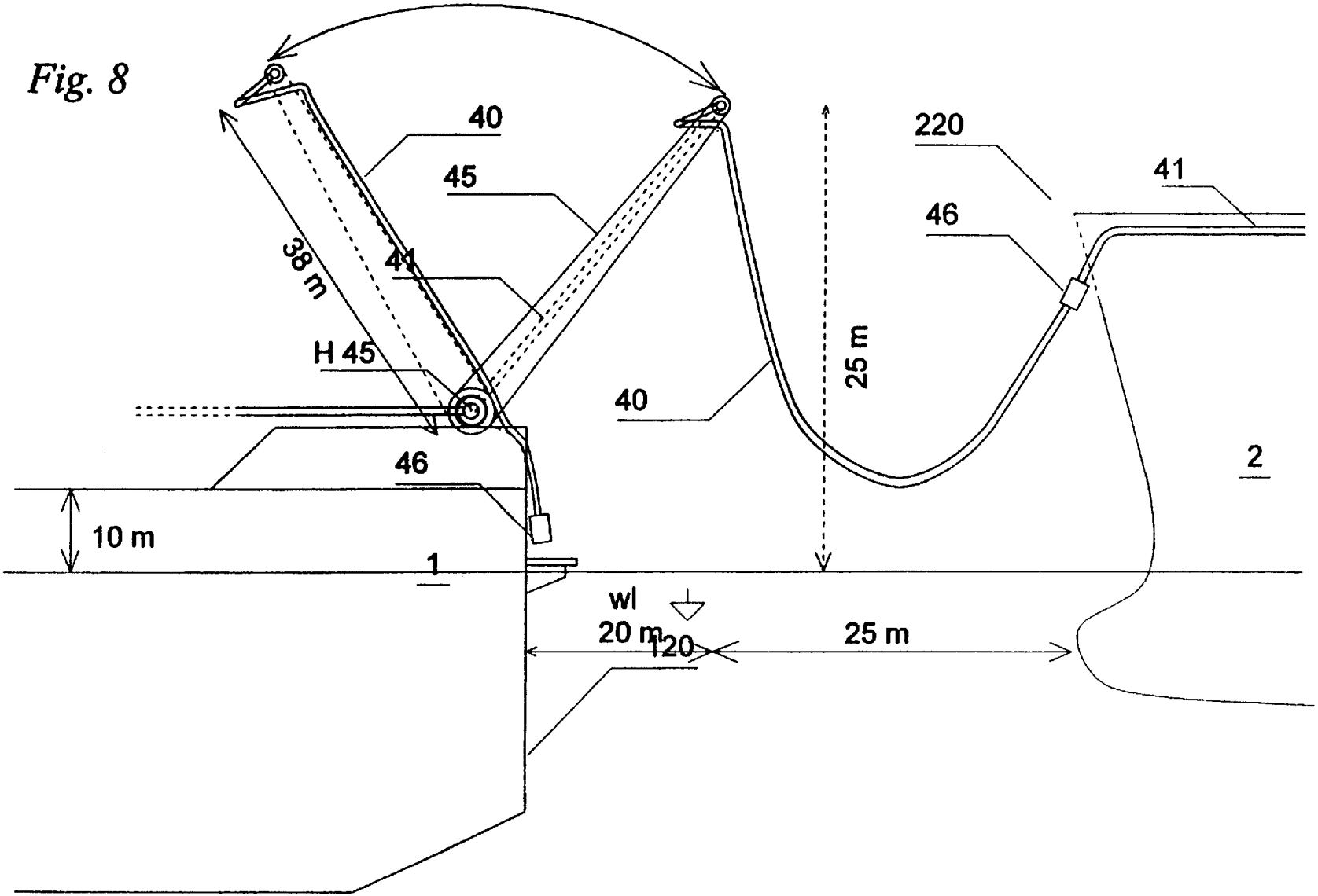

FIG. 8 shows an alternative preferred embodiment of the crane boom 45 arranged about 12 metres forwards with respect to the stern 120 of the FPSO vessel 1. The length of the crane boom 45 in this embodiment may be about 38 metres, and the crane boom 45 may be pivoted sternwards to that the top reaches about 20 metres out from the stern 120, and reaching about 25 metres above the bow 220 and the stern 120, and being about 35 metres above the sea. If the flexible LNG pipe 40 has a length of about 38 m+13 m=51 m, it will be able to hang in a slack hanging arch which almost touches the sea by a separation between the vessels of about 45 m.

Alternatively the flexible LNG pipe may be stored as shown in FIG. 3, spanned from the crane boomed 45 under a half drum arranged on the stern of the FPSO vessel 1 and up back to a winch on the deck.

Figures 9, 10, 11:
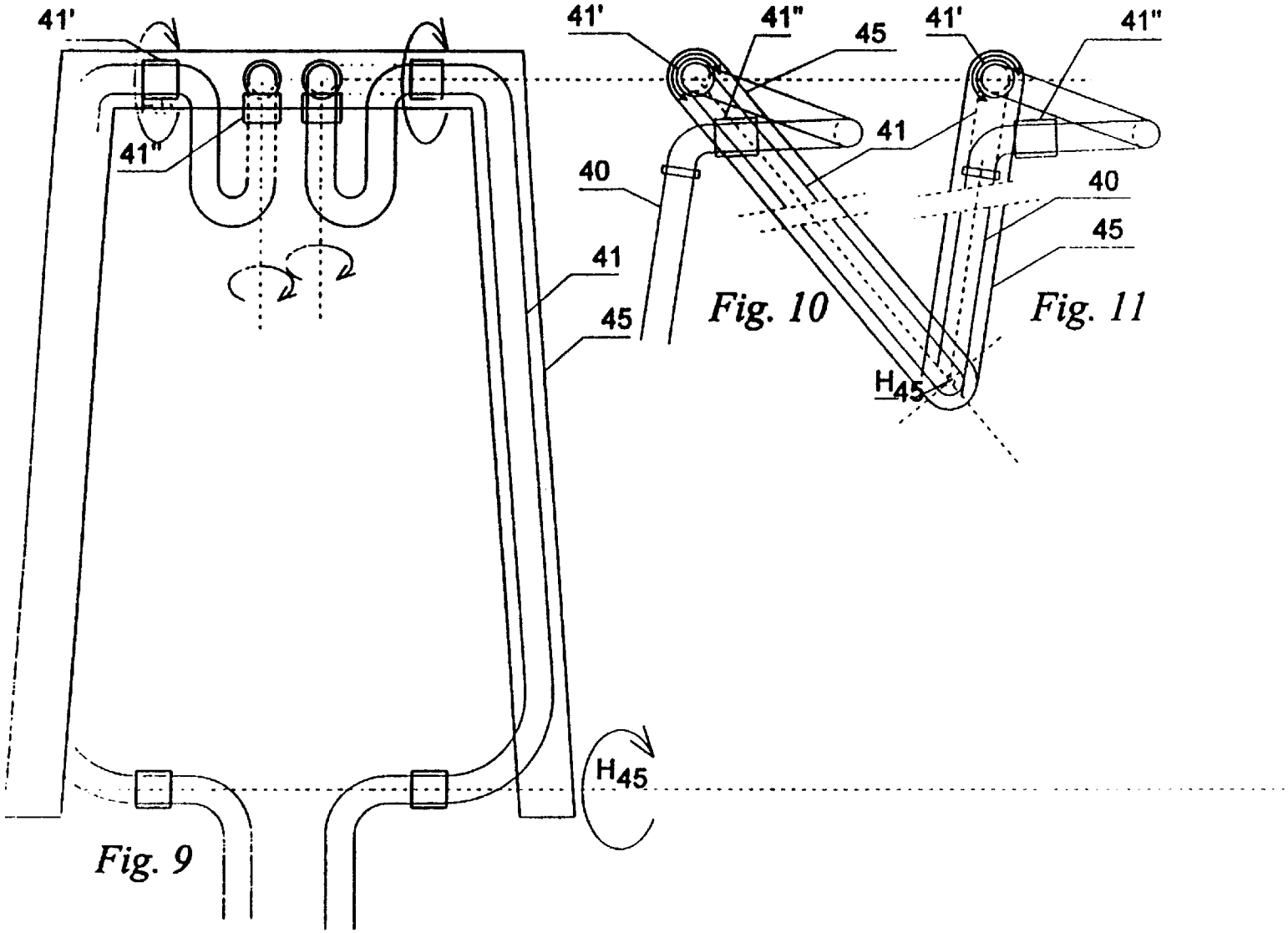

FIGS. 9, 10 and 11 show views and partial sections the alternative preferred embodiment from FIG. 8. The crane boom 45 is designed as an A-crane 45, with at leat one or several rigid LNG pipes 41 arranged with needed swivels in the axis H45. The LNG pipe 41 comprises in this embodiment also a horizontal swivel articulation 41' and an LNG pipe swivel articulation 41" perpendicularly to the LNG pipe swivel articulation 411 in the upper end of the crane-boom 45. These two LNG pipe swivel articulations may replace or be a an additional contribution to the LNG pipe swivel articulations 42 displayed in FIGS. 3*c* and 3*d*. The LNG pipe swivel articulations 41' and 41" may be rotated and guided by a hydraulic power device 410 to rotate the swivel articulations between a load transfer position shown in FIG. 10 and a passive or "parked" position shown in FIG. 11.

Transfer devices for unloading LNG from the LNG tank vessel 2 to a receiving plant onshore is not described here.

What is claimed is:

1. The for production, storage and export of liquid natural gas (LNG) from a Floating Production, Storage and Offloading (FPSO) vessel with an LNG liquefaction plant, with a cryogenic transfer device arranged between the FPSO vessel and an LNG tank vessel comprising:

a LNG buffer tank located in the FPSO vessel, with buffer storage capacity for temporary storage of produced LNG;

a mooring device arranged for short separation moorage between a stern of the FPSO vessel and a bow of the LNG tank vessel;

a cryogenic transfer device arranged between the stern of the FPSO vessel and the bow of the LNG tank vessel, comprising a flexible LNG pipe, arranged for continuous transfer of produced LNG; and at least one LNG storage tank in the LNG tank vessel, arranged for being filled via the cryogenic transfer device until a desired degree of filling of the LNG tank vessel is achieved.

2. The system according to claim 1, wherein the cryogenic transfer device extends centrally between the stern of the FPSO vessel and the bow of the LNG tank vessel bow (220), and without making contact with hawsers on the mooring device.

3. The system according to claim 2, further comprising a support wire with sheaves for carrying the flexible LNG pipe between the FPSO vessel and the tank vessel.

4. The system according to claim 2, wherein the flexible LNG pipe partly lies in the sea between the FPSO vessel and the LNG tank vessel.

5. The system according to claim 1, wherein the cryogenic transfer device is arranged to extend entirely above the water line between the FPSO vessel and the tank vessel.

6. The system according to claim 1, wherein the cryogenic transfer device for LNG comprises: a crane boom arranged by the stern of the FPSO vessel stern with an LNG pipe arranged in the crane boom, further connected to the flexible LNG pipe further being arranged for connection to a connector arranged in the bow of the LNG tank vessel, connected to a second LNG pipe further leading to the LNG storage tanks.

7. The system according to claim 6, wherein the crane boom is pivotable about a horizontal axis.

8. The system according to claim 1, comprises at least one set of mooring hawsers extending from starboard and port sides respectively of the FPSO vessel from the stern of the FPSO vessel, to the bow of the LNG tank vessel, with the hawsers constituting two essentially equal sides of an isosceles triangle with the stern as ground line.

9. The system according to claim 8, wherein the mooring device between the stern of the FPSO vessel, and the bow of the LNG tank vessel, has a separation of less than 140 m between the vessels.

10. The system according to claim 9, wherein the separation between the vessels is less than 75 m.

11. The system according to claim 9, wherein the separation between the vessels is less than 60 m and more than 30 m.

12. The system according to claim 1, wherein the storage capacity of the LNG buffer tank is between 20000 $m^3$ and 80000 $m^3$.

13. The system according to claim 12, wherein buffer storage capacity of the LNG buffer tank is between 30000 $m^3$ and 45000 $m^3$.

14. The system according to claim 1, wherein total storage capacity of the LNG storage tanks is between 50000 $m^3$ and 150000 $m^3$.

15. The system according to claim 14, wherein total storage capacity of in the LNG storage tanks is between 120000 $m^3$ and 14000 $m^3$.

16. The system according to claim 1, further comprising:

a reliquefaction plant in the tank vessel arranged for reliquefying boiled-off LNG from the LNG pipe and further arranged for returning the reliquefied LNG to the LNG tanks.

17. The system according to claim 1, further comprising at least one ordinary storage tank for liquid gas condensate on board the FPSO vessel.

18. The system according to claim 17, further comprising a floating loading hose arranged for transfer of liquid gas condensate from the storage tank on the FPSO vessel, to a manifold of an ordinary tank vessel with tanks.

19. A method for floating production, storage and export of liquid natural gas (LNG) comprising the steps of:

a) mooring a bow of an LNG tank vessel bow to a stern of a FPSO vessel by means of a mooring device arranged for short separation moorage;

b) connecting a cryogenic transfer device comprising a flexible LNG pipe (40), arranged for transfer of produced LNG arranged by the FPSO vessels stern, to a bow of the LNG tank vessel;

c) consecutive transfer of LNG from a LNG liquefaction plant via the cryogenic transfer device, to LNG storage tanks on board the LNG tank vessel, until a desired degree of filling of the LNG tank vessel is achieved;

d) disconnecting the LNG tank vessel simultaneously with continuous production and temporary storage of the produced LNG into a LNG buffer tank on board the FPSO vessel;

e) mooring a bow of a second LNG tank vessel as under step (a) and connection of the second LNG tank vessel's bow to the FPSO vessel's stern via the flexible cryogenic transfer device and discharging of the LNG buffer tank to the second LNG tank vessel simultaneously with resumption of the consecutive transfer of produced LNG to the second LNG tank vessel.

20. A method according to claim 19 further comprising the steps of:

during the LNG tank vessel's absence or disconnected state;

connecting a floating loading hose arranged at the FPSO vessel's stern to an ordinary tank vessel; and transferring gas condensate via the floating loading hose to the ordinary tank vessel's storage tanks.

21. A method according to claim 20, wherein the floating loading hose is connected to a midship manifold of the tank vessel.

22. A method for floating production, storage and export of liquid natural gas (LNG) and gas condensate, comprising the following steps:

a) mooring a bow of an LNG tank vessel to a stern of an FPSO vessel by means of a mooring device arranged for short separation moorage;

b) connecting a cryogenic transfer device comprising a flexible LNG pipe, arranged for transfer of produced LNG arranged by the FPSO vessels stern, to the LNG tank vessel bow;

c) transferring continuously produced LNG from a LNG liquefaction plant via the cryogenic transfer device to LNG storage tanks on board the LNG tank vessel until a desired degree of filling of the LNG tank vessel is achieved;

d) storing of the produced gas condensate in gas condensate tanks in the FPSO vessel;

e) disconnecting the LNG tank vessel simultaneously with still continuous production and temporary storage in a LNG buffer tank on board the FPSO vessel; and f) during a disconnected state of the LNG tank vessel connecting together an ordinary tank vessel with the FPSO vessel to tanks in the ordinary tank vessel.

23. A device for transferring liquid natural gas (LNG) from a floating production, storage and offloading vessel, hereafter called an "FPSO vessel" to an LNG tank vessel having LNG tanks by means of a cryogenic transfer device comprising:

a) a crane boom arranged near a stern of the FPSO vessel comprising at least one relatively rigid LNG pipe, the crane boom being pivotable about a horizontal axis, the LNG pipe being connected to b) at least one flexible LNG pipe arranged to be connected to c) a connector arranged in a bow of the LNG tank vessel.

24. The device according to claim 23, further comprising:

a first LNG pipe articulation being rotatable about two axes being generally orthogonal to a main axis of the LNG pipe, and arranged between the LNG pipe and the flexible LNG pipe.

25. The device according to claim 24, further comprising:

a second LNG pipe articulation being rotatable about two axes being generally orthogonal to a main axis of the LNG pipe, and arranged between the flexible LNG pipe and the LNG tank vessel.

26. The device according to claim 25, wherein the two axes of the first LNG pipe articulation are orthogonal and the two axes of the second LNG-pipe articulation are orthogonal.

27. The device according to claim 23 comprising a first LNG pipe swivel, arranged between the LNG pipe and the flexible LNG pipe.

28. The device according to claim 27, further comprising:

a second LNG pipe swivel arranged between the flexible LNG pipe and the LNG tank vessel.

29. The device according to claim 28, wherein there are at least two courses of flexible LNG pipes between the vessels.

30. The device according to claim 29, comprising junction articulations arranged at an end of the at least two flexible LNG pipes between the swivels.

31. The device according to claim 23, further comprising:

a second LNG pipe arranged between the connector and the LNG tanks of the tank vessel.

32. The device according to claim 31, further comprising:

an emergency disconnector arranged between the connector and the second LNG pipe.

33. The device according to claim 23, further comprising:

a reliquefaction plant arranged to reliquefy boiled-off LNG from the LNG tanks and further arranged to return the reliquefied LNG back to the LNG tanks or to an LNG buffer tank on the FPSO vessel.

34. The device according to claim 23, further comprising:

a mooring device arranged between the stern of the FPSO vessel, and the bow of the LNG tank vessel with separation of less than 140 metres between the vessels.

35. The device according to claim 34, wherein:

the transfer device is configured so that the flexible LNG pipe is extended in a vertical plane between the middle of the stern of the FPSO vessel to the middle of the bow of the LNG vessel, centrally and without touching the mooring hawsers.

36. The device according to claim 34, wherein the device is configured so that the separation between the vessels is less than 75 m.

37. The device according to claim 36, wherein the device is configured so that the separation between the vessels is less than 60 m and more than 30 m.

38. The device according to claim 23, wherein the crane boom is pivotable about a vertical axis.

39. The device according to claim 23, wherein an upper end of the crane boom is configured as a jib pivotable in the vertical plane about an athwartships oriented horizontal axis.

* * * * *